US005558022A

United States Patent [19]

Mason et al.

[11] Patent Number: 5,558,022

[45] Date of Patent: Sep. 24, 1996

[54] TRANSFER MEANS FOR BATHING INVALID

[75] Inventors: James R. Mason, Mandurah; Philip J. Mason, Wanneroo, both of Australia

[73] Assignee: Raceside Holdings Pty Ltd., Western Australia, Australia

[21] Appl. No.: 302,922

[22] PCT Filed: Jan. 18, 1993

[86] PCT No.: PCT/AU93/00019

§ 371 Date: Sep. 21, 1994

§ 102(e) Date: Sep. 21, 1994

[87] PCT Pub. No.: WO93/14731

PCT Pub. Date: Aug. 5, 1993

[30] Foreign Application Priority Data

Jan. 17, 1992 [AU] Australia ..... PL0477

[51] Int. Cl.[6] ..... E01B 23/00; A47K 3/02

[52] U.S. Cl. ..... 104/126; 4/560.1; 5/81.1 R

[58] Field of Search ..... 4/560.1, 578.1, 4/254, 579, 611; 5/81.1; 104/94, 107, 89, 242, 243, 246, 126; 312/334.8, 334.9, 334.14, 334.15

[56] References Cited

U.S. PATENT DOCUMENTS

| | | | |
|---|---|---|---|
| 2,545,269 | 3/1951 | Ford | 312/334.13 |
| 3,074,356 | 11/1963 | Parker et al. | 104/94 X |
| 3,758,894 | 9/1973 | Finley . | |
| 4,168,549 | 9/1979 | Davies | 4/578.1 |
| 4,266,305 | 5/1981 | Kavaloski et al. | 4/254 X |
| 4,354,791 | 10/1982 | Antonellis . | |
| 4,939,799 | 7/1990 | Van Horel | 4/579 X |

FOREIGN PATENT DOCUMENTS

| | | |
|---|---|---|
| 65573/86 | 11/1986 | Australia . |
| 1060771 | 4/1977 | Canada . |
| 3541001 | 1/1987 | Germany . |
| 3704628 | 9/1988 | Germany . |

*Primary Examiner*—Charles E. Phillips
*Attorney, Agent, or Firm*—Larson & Taylor

[57] ABSTRACT

A support (10) for moving an object between two locations. The support (10) has one or more elongate members (12) upon which a platform, such as a seat (50), can be slid. The elongate member (12) has a guide rail (15) which has two flanges (17) each terminated with an arcuate groove (18). The flanges (17) and the arcuate grooves (18) form a track (22) in which wheels (24) of the seat (50) can run.

Typically, the support (10) is used for moving the seat (50) into and out of a shower recess or over a bath for the bathing of the aged and invalids. The guide rail (15) can also be used as a curtin track, a track for a sliding panel and the like.

13 Claims, 3 Drawing Sheets

TRANSFER MEANS FOR BATHING INVALID

FIELD OF INVENTION

This invention relates to a transfer means for moving an object between two locations. The transfer means of the present invention is particularly, although not exclusively, envisaged for use by the invalid or disabled for use in moving into and out of a shower or bath. The transfer means is also envisaged for use in moving objects in general from one place to another.

One of the greatest difficulties faced by invalids or disabled persons in their daily routine is bathing. Due to ill-health, old-age or disability a person may not be able to stand-up without assistance whilst taking a shower. To help such a person a chair or stool can be placed in the shower recess or bath area so that the person can have a shower whilst being seated. A disadvantage of such chairs or stools is that an able bodied person assisting the invalid or disabled person must manoeuvre the invalid or disabled person into the shower or bath before being able to seat them on the chair or stool. This is difficult where the shower or bath is small and even more difficult once the shower or bath is wet.

Aids have been devised to help make bathing easier for the invalid or disabled. Such aids have been known to take the form of bath boards which are designed to fix across the top of the bath thereby creating a seating platform for washing or showering. Other aids include bath seats which may be provided with a back rest. Such boards or seats can be secured to the bath by hinged arms which hook onto the top of the bath and are sometimes provided with means to wedge the bottom of the seat to the walls of the bath for additional security. Other securing means take the form of brackets which ensure that the seats or boards remain locked in position.

SUMMARY OF THE INVENTION

Therefore, it is an object of the present invention is to provide a transfer means for moving an object between two locations, such as, moving a seat into and out of a bath or a shower recess.

In accordance with one aspect of the present invention there is provided a transfer means for moving an object between two spaced apart locations, the transfer means comprising:

a platform means for carrying the object, the platform means having a roller means for allowing the platform means to roll;

an elongate member disposable substantially horizontally, the elongate member having a guide rail extending substantially along its length, the guide rail defining a track within which the roller means of the platform means can roll, the roller means being confined to movement along the guide rail and inhibited from movement out of the guide rail, the roller means allowing movement of the platform means between the two spaced apart locations, the guide rail having a cut-out for allowing entry and exit of the roller means of the platform means from the guide rail; and, a pivot means for pivotably attaching one end of the elongate member to a structural member, the pivot means allowing pivoting of the elongate member between a substantially horizontal in-use position and a substantially vertical storage position;

wherein, the platform means can be removed from the elongate member to allow pivoting of the elongate member between the in-use and storage positions.

Preferably, the transfer means is capable of movement between said substantially horizontal position when in use and a substantially vertical position when in a stored position.

Preferably, the transfer means is hingedly fixed to a structural member so that it can be manoeuvred between the stored and in-use positions. The structural member is typically in the form of a wall.

Preferably, the platform means may be detachably mounted to transfer means to allow for ready removal and storage of the platform means. Furthermore, the base of the platform means may be provided with engaging means to engage the platform means with the elongate member.

Typically, the engaging means is in the form of rollers or guides which are slidable in a suitably configured track provided on the elongate member.

The support member is preferably in the form of a leg which is hingedly connected to the elongate member so that the leg is maintained in a substantially vertical position when in use.

In the preferred embodiment, a pair of elongate members are provided on which the platform means is mounted and supported for slidable movement.

In accordance with another aspect of the present invention there is provided a guide rail for guiding a platform means the guide rail comprising:

a base channel capable of fixing onto a structural member with respect to which the moveable member is to move; and, a track depending from a side wall of the base channel, the track having two flanges each terminated in an arcuate groove, the flanges diverging away from the side wall and arcuate grooves having their concave sides disposed toward each other;

whereby, in use, the track can receive and guide the platform means along the base channel.

The base channel may be either open, such as in a trough, or closed, such as in a conduit.

The flanges could be gusseted to the side wall.

Typically, the flanges are substantially flat and dispose the arcuate grooves at a distance from the side wall of the base channel. The flanges preferably project from the side wall at an angle between 25° and 75°, more preferably at an angle of about 45°.

Preferably, the arcuate grooves are semi-circular in cross-section.

BRIEF DESCRIPTION OF THE DRAWINGS

An exemplary embodiment of the invention will now be described with reference to the accompanying drawings, in which.

DESCRIPTION OF THE PREFERRED EMBODIMENT

Figure 1:
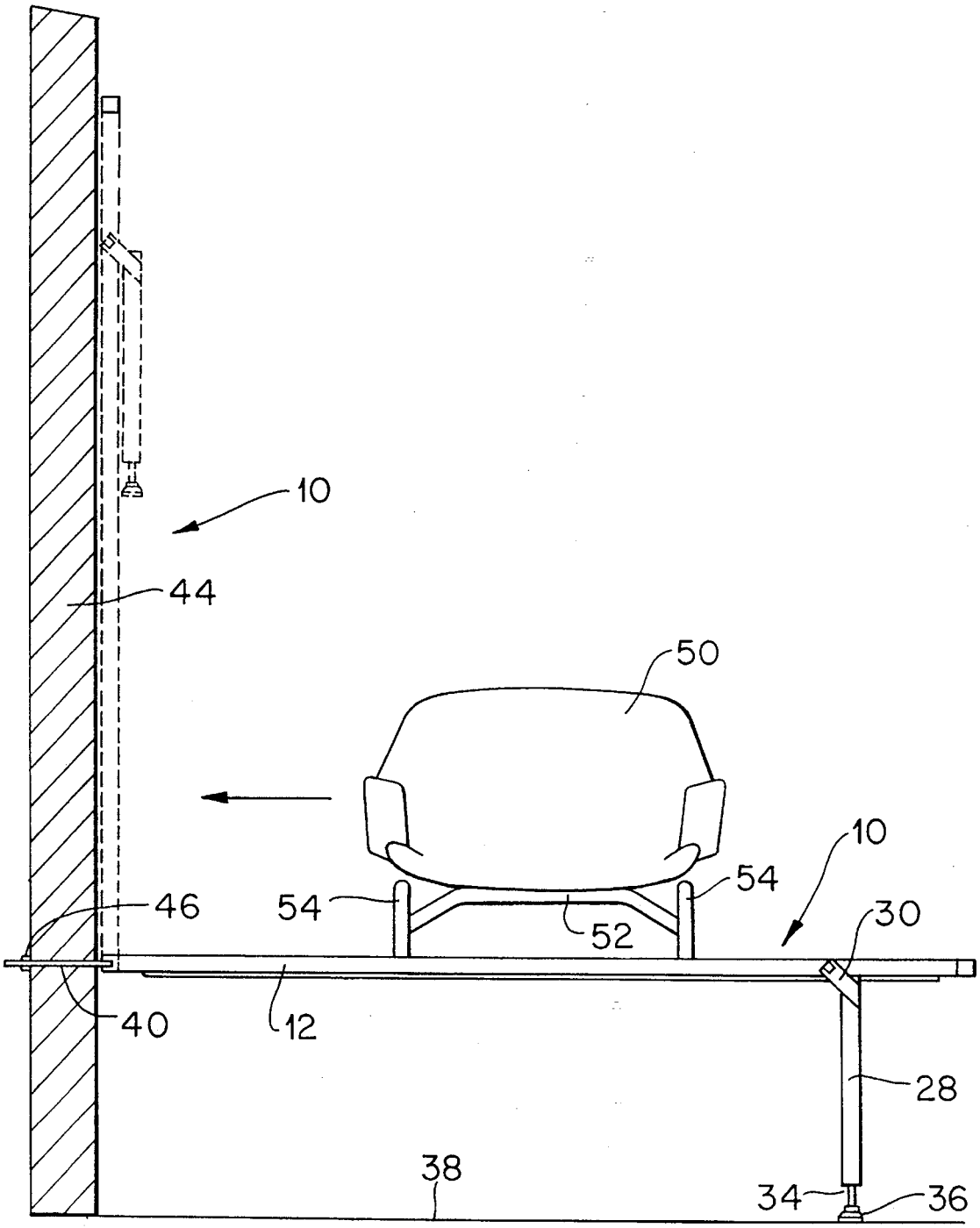
FIG. 1 is a front elevation of a transfer means, shown with a platform means in the form of a seat.
Figure 2:
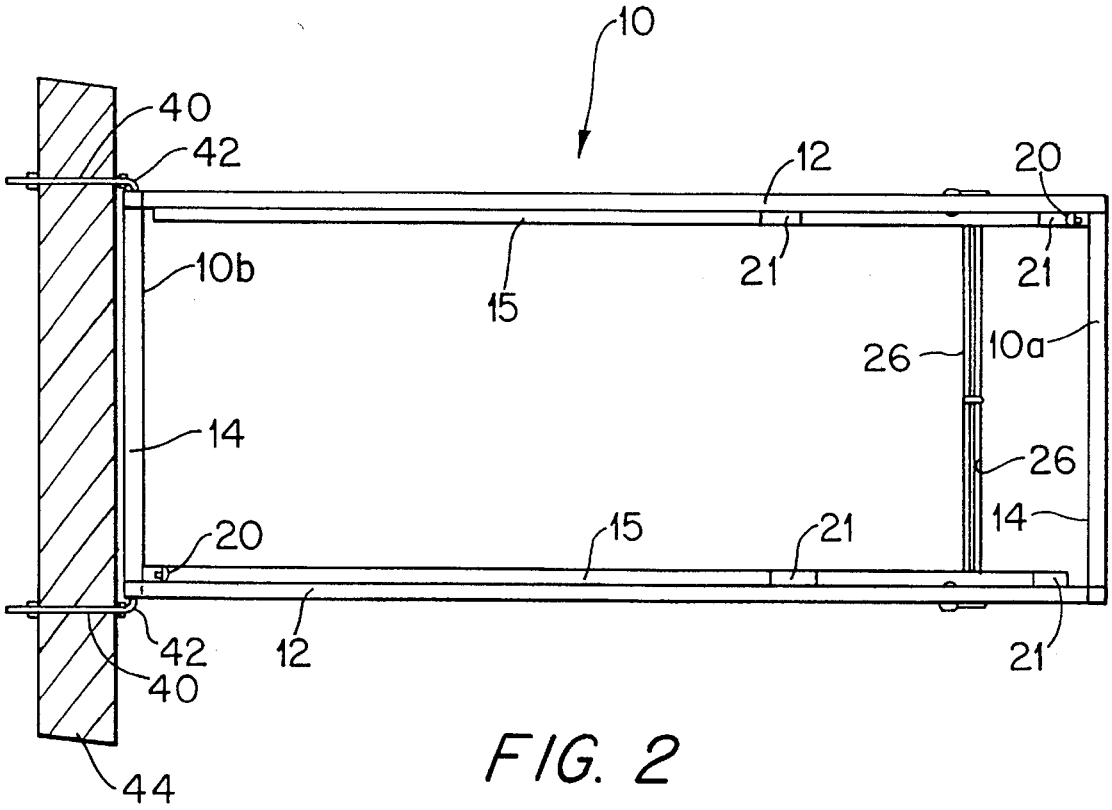
FIG. 2 is a plan view of a transfer means of FIG. 1, shown without the seat.

As best depicted in FIGS. 1 and 2 the embodiment is directed to a transfer means 10 having two elongate members 12 and two transverse members 14. The elongate members 12 and transverse members 14 form a substantially rectangular frame structure and are typically constructed from hollow metal section material.

Figure 6:
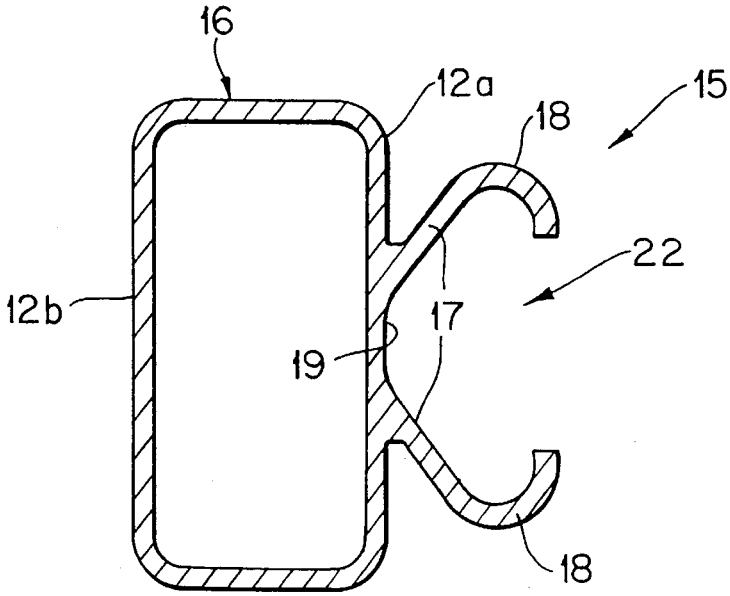
Figures 3, 4, 5:
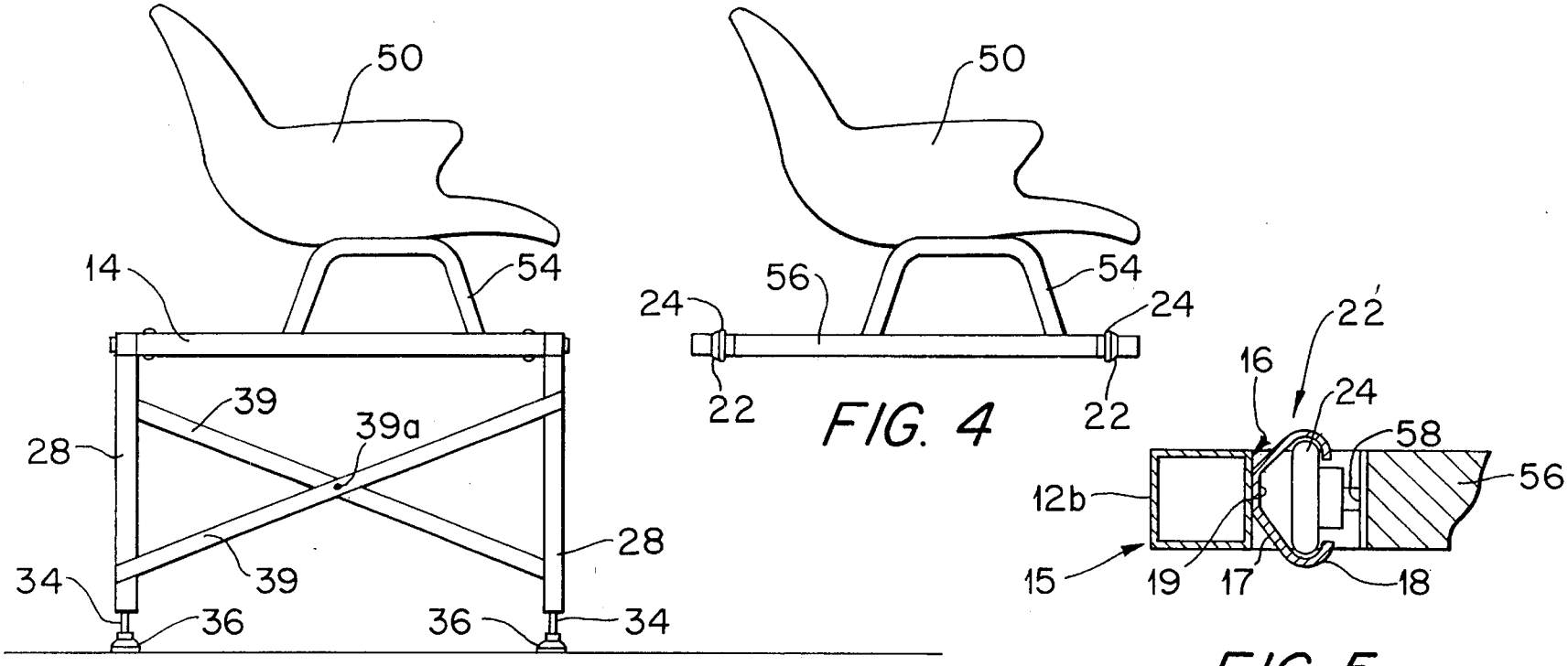
FIG. 3 is a side elevation view of the transfer means of FIG. 1.
FIG. 4 is a side elevation view of the seating means of FIG. 1.
FIG. 5 is a fragmentary view showing the coupling of the seat onto the transfer means of FIG. 1, shown to a larger scale; and, FIG. 6 is a cross-sectional view of a guide rail of the transfer means of FIG. 1, shown to a larger scale.

As shown in FIGS. 2, 5 and 6 each elongate member 12 includes a guide rail 15 formed on a base channel 16 and two flanges 17 each terminating in an arcuate groove 18. The flanges 17 are substantially flat and diverge from the side wall 12*a*. The flanges 17 each project at an angle of between 25° and 75° more preferably about 45° to a side wall 12*a* of each of the elongate members 12. Typically, a land 19 is located between the intersection of the side wall 12*a* and the two flanges 17 so as to receive a fixing means such as a bolt or screw for fixing the guide rail 15 to a wall or the like, although such is not necessary in the present embodiment. The arcuate grooves 18 have their concave sides disposed towards each other. Typically, the arcuate grooves 18 are semi-circular in cross-section. The guide rail 15 extends for almost the full length of the elongate members 12 but terminates a short distance away from the ends thereof. As shown in FIG. 2 a rubber stopper 20 is placed at both ends or at one of the end of the guide rail 15. Also, the upper ones of the arcuate grooves 18 each have cut-outs 21. Each of the upper arcuate grooves 18 has one cut-out 21 located proximate a free end 10*a* of the transfer means 10. The upper arcuate grooves 18 each have another cut-out 21 located intermediate the length of the guide rails 15 and spaced from the first mentioned cut-outs 21 such that a platform means, in the form of a seat, can be lowered into and raised out of a track 22 formed by the area bounded by the flanges 17 and the arcuate grooves 18. The track 22 is dimensioned to accept and contain a wheel 24.

Proximate the free end 10*a* of the transfer means 10 is located a pair of support members in the form of two legs 28. The legs 28 are constructed from hollow metal section. The top of the legs 28 are hingedly connected to the elongate members 12 by means of a hinge member 30 which extends obliquely from each elongate member 12 to each leg 28. The bottom of each of the legs 28 is provided with a metal rod 34 on the free end of which is located a rubber stopper 36 for contact with the floor surface 38. If desired the height of the leg 28 can be made adjustable. The legs 28 are provided with a pair of cross-braces 39 which extend from proximate one end of each leg 28 to proximate the opposite end of the other leg 28. The cross-braces 39 are connected to each other at their cross-over point 39*a*.

Two mounting rods 40 are located at the other end 10*b* of the transfer means 10. Each rod 40 is provided with a curve portion 42 to enable the rod 40 to be pivotably mounted to an outer side wall 12*b* of the elongate member 12. The rods 40 are of sufficient length to completely extend through the thickness of a wall 44 to which the transfer means 10 is to be attached. Typically, the wall 44 is a wall of shower recess or over a bath. The rods 40 are also of sufficient length so that the end of each of the rods protrudes from the other side of the wall 44 as shown in FIGS. 1 and 2.

The transfer means 10 carries a seat 50 which is configured to accommodate a user, such as an invalid or aged person. Particularly as shown in FIGS. 2 and 4 the under portion of the seat 50 is provided with a base portion 52 to each side of which is located an inverted generally U-shaped member 54. The free ends of each U-shaped member 54 are connected to a bar 56. As shown in FIG. 5 the ends of each bar 56 have a short metal rod 58 which provides a rotatable mount for the wheels 24. The wheels 24 are dimensioned so as to be received in the tracks 22. Preferably, the vertical movement of the wheels 24 within the tracks 22 is limited so as to inhibit the chance of the wheel 24 jumping out of the track 22. That is the circumferential portion of the wheel 24 is retained within the two arcuate grooves 18.

In use, the transfer means 10 is first attached to the wall 44 in the shower recess (or the wall of the bathroom which is directly adjacent the bath). The end of the support means having the mounting rods 40 is inserted through holes drilled or bored through the wall 44. To secure the rods 40 in place any suitable securing means can be used, such as, for example nuts or rubber stoppers 46 as shown in FIGS. 1 and 2. The rubber stoppers 46 are attached to the end of the rod 40 which protrudes from the other side of the wall 44 so as to substantially keep the end 10b of the transfer means 10 in position.

The transfer means 10 is then set to a substantially horizontal position as shown in FIG. 1 with the leg 28 in a substantially vertical portion in contact with the floor 38. The seat 50 is then mounted on the support means 10 by lowering the wheels 24 through the cut-outs 21 and into the track 22 of the guide rail 15. The rubber stoppers 20 provided at the ends of the guide rail 15 ensure that the seat 50 is confined to sliding movement in the track and ensures that the seat 50 does not slide out of the guide rail 15.

with the seat 50 located proximate the free end 10*a* of the transfer means 10 the user can be seated upon the seat 50. Such seating may be accomplished by the user or with the help of an assistant. The user or an assistant then slides the seat 50 along the elongate members 12 towards the other end 10*b* of the transfer means 10, at the wall 44, until the correct showering position is reached.

After showering the seat 50 is then slid back to the free end 10*a* of the transfer means 10 and the user then rises from or is assisted off the seat 50.

The transfer means 10 can be stored out of the way by removing the seat 50 from the guide rails 15 and pivoting the transfer means 10 about the rods 40 until it reaches a substantially vertical position as shown phantom in FIG. 1. Typically, a latch is fixed to the wall 44 for locking the transfer means 10 in the substantially vertical position. Alternatively, the end 10*b* of the transfer means 10 can be spaced out from the wall 44 so that the transfer means 10 leans onto the wall 44 and is maintained substantially vertically by the force of its weight.

Due to the hinged connection of the legs 28 to the elongate members 12 the legs 28 are kept in a substantially vertical position at all times so that when in the stored position the legs 28 are located adjacent and parallel to the elongate members 12 for tidy storage.

The transfer means 10 has the advantage that an invalid or aged person can be easily moved into and out of a shower recess or over a bath. A person assisting the user of the transfer means 10 need not step into the shower or the bath as is essential if the transfer means 10 is not used. The guide rail 15 has the advantage that it secures the wheels 24 into the track 22 and so movement of the wheels 24 out of the track 22 is unlikely. Still further, the transfer means 10 can easily be moved out of the way when not in use.

In an alternative embodiment the transfer means 10 is hingedly attached to the wall by brackets, or the like. In hospital or communal home environments, the brackets may be provided with means to allow attachment of the transfer means 10 at various heights on the wall to accommodate users of differing heights.

In another embodiment the transfer means 10 may be affixed to the wall by suction cups or the like. Still further the transfer means 10 could have a set of legs 28 at each of the ends 10*a* and 10*b* so as to be free standing. In such a case the legs require a locking mechanism to maintain the legs substantially at right angles to the elongate members 12.

It should be appreciated that whilst this invention has been described as an aid to assist the invalid or disabled during showering or bathing, it can also have other users. For example, the transfer means 10 could be used in classrooms, workshops and the like for the disabled or invalid to provide ready mobility between spaced apart locations. In such cases a system of the transfer means 10 could be arranged alongside work benches or tables or the like so that the user can easily move from one side of the work bench to the other.

Another example of an alternative application for the transfer means 10 is in industry where the seat 50 is replaced by a platform to enable the transport or articles.

In an alternative arrangement the transverse member 14 at the free end 10*a* of the transfer means 10 is removed and the seat 50 can be positioned at 90° to that shown in FIGS. 1 and 3 so that the user can be slid into a shower where the shower rose is on the same wall 44 as the mounting rods 40.

I have discovered that the guide rail 15 is particularly strong and has uses in many other fields. For example, the guide rail 15 can be used as a curtain track. In such a case a bolt or screw is fitted through the land 19, through the base channel 16 and into the wall. The guide rail 15 can also be used for mounting sliding panels, such as sliding doors. Further, the guide rail 15 can be used for butchers overhead rails and other forms of overhead rails requiring a runner or roller. The important features of the guide rail 15 are the angle at which the flanges 17 project from the side wall 12*a* and the arcuate grooves 18 at the free ends of the flanges 17. The land 19 between the flanges 19 allows use of a relatively large fixing screw of bolt to be used to fix the guide rail 15 to a wall or the like. Also, the land 19 increases the strength of the guide rail 15 by spacing the two flanges 17 apart. Preferably, the guide rail 15 is extruded. Typically, the guide rail 15 is made from aluminium, although other metal materials could be used. A gusset could be provided between the flanges 17 and the side wall 12*a*.

Modifications and variations such as would be apparent to a skilled addressee are considered within the scope of the present invention. For example, the seat 50 could be provided with a lock means to fix the seat with respect to the elongate members 12 so as keep the seat steady whilst the person is manoeuvred into and out of the seat 50 and so as keep the seat 50 steady whilst under the shower or over the bath. Also, the elongate members 12 could be set at an angle so as to bias movement of the seat 50 either into or, out of the shower as desired. Further, the wheels 24 could be attached directly onto the seat 50. Still further, the transfer means 10 could have a bias means to assist in moving the transfer means 10 to the substantially vertical position. Still further, the cut-outs 21 located intermediate the length of the elongate members 12 could be omitted end each set of wheels of the seat 50 inserted via the cut-outs 21 located proximate the free end 10*a*. Still further, the base channel 16 of the guide rail 15 could be of greater or lesser size with respect to the flanges 17 and the arcuate grooves 18. Still further, the base channel 16 could be in the form of an open trough, that is omitting the side wall 12*b*.

We claim:

1. A transfer means for moving an object between two spaced apart locations, the transfer means comprising:

a platform means for carrying the object, the platform means having a roller means for allowing the platform means to roll between the said two locations;

at least two elongate members disposable substantially horizontally, each elongate member having a guide rail extending substantially along its length, the guide rail defining a track within which the roller means can roll, the guide rail being shaped so that the roller means is confined within the guide rail so as to limit movement of the roller means to movement along the guide rail and so that the roller means is inhibited from movement out of the guide rail either vertically or horizontally along substantially the entire length of the guide rail, the roller means allowing movement of the platform means between the two spaced apart locations, the guide rail having a cut-out located in an upper portion of the guide rail for allowing entry and exit of the roller means from the guide rail by movement of the roller means in an upward direction out of the guide rail through the cut-out so that the platform means can be attached to the guide rail and removed from the guide rail respectively, and the guide rail having means to inhibit removal of the platform means from the ends of the guide rail; and a pivot means for pivotably attaching one end of each of the elongate members to a structural member, the pivot means allowing pivoting of the elongate members between a substantially horizontal in-use position and a substantially vertical storage positions;

wherein, the platform means can be removed from the elongate members to allow pivoting of the elongate members between the in-use and storage positions.

2. A transfer means according to claim 1, in which the guide rail comprises:

a base member which is hollow so as to provide torsional rigidity along the length of the guide rail against the force of the weight of the object; and, a track depending from one side wall of the base member, the track having two flanges each terminated in an arcuate groove, the flanges diverging away from the side wall, the arcuate grooves having their concave sides disposed towards each other and free ends of the arcuate grooves extending towards each other by a distance of about 30% of the diameter of the roller means so as to inhibit the roller means being forced out of the track under the force of the weight of the object, and the cut-out being located in the arcuate groove of an upper most one of the flanges.

3. A transfer means according to claim 2, in which the flanges diverge from the side wall of the base member at an angle of between 25° and 75° to the side wall.

4. A transfer means according to claim 3, in which the angle is about 45°.

5. A transfer means, according to claim 2, in which the two flanges have a length which ensures that the arcuate grooves are spaced from the side wall of the base member a distance which provides a clearance between the side wall of the base member and the roller means so as to avoid fouling of the roller means by material which may become lodged in the track.

6. A transfer means according to claim 2, in which the guide rail also has a land located between a juncture of the two flanges and the side wall of the base member so that there is a clearance between the roller means and the side wall of the base member.

7. A transfer means according to claim 1, in which the platform means has two roller means located at one end of the platform means and the other located at the other end of the platform means, the length of the platform means being shorter than the length of the guide rail, and in which the guide rail has two cut-outs, the cut-outs being spaced apart by a distance which allows for simultaneous insertion of the two spaced apart roller means of the platform means into the guide rail.

8. A guide rail for guiding a platform means having a roller means which rolls in the guide rail for allowing the platform means to move along at least two guide rails so that the platform means can transport an object between two spaced apart locations, the guide rail comprising:

a base member which is hollow so as to provide torsional rigidity along the length of the guide rail against the force of the weight of the object; and, a track depending from a side wall of the base member, the track having two flanges each terminated in an arcuate groove, the flanges diverging away from the side wall, the arcuate grooves having their concave sides disposed towards each other and free ends of the arcuate grooves extending towards each other by a distance of about 30% of the diameter of the roller means so as to inhibit the roller means from being forced out of the track under the force of the weight of the object.

9. A guide rail according to claim 8, in which the two flanges have a length which ensures that the arcuate grooves are spaced from the side wall of the base member a distance which provides a clearance between the side wall of the base member and the roller means so as to avoid fouling of the roller means by material which may become lodged in the track.

10. A guide rail according to claim 8, having a land located between a juncture of the two flanges and the side wall of the base member so that there is a clearance between the roller means and the side wall of the base member.

11. A guide rail according to claim 8, in which the flanges diverge from the side wall at an angle of between 25° and 75°.

12. A guide rail according to claim 11, in which the angle is about 45°.

13. A guide rail according to claim 8, also having cut-outs in one of the flanges and its arcuate groove for allowing entry and exit of the roller means of the platform means from the guide rail.

* * * * *